United States Patent [19]

Sekiya et al.

[11] 4,107,915

[45] Aug. 22, 1978

[54] ELECTRONIC TIMEPIECE

[75] Inventors: Fukuo Sekiya; Shigeru Morokawa; Yasushi Nomura, all of Tokorozawa, Japan

[73] Assignee: Citizen Watch Co., Ltd, Tokorozawa, Japan

[21] Appl. No.: 751,889

[22] Filed: Dec. 17, 1976

Related U.S. Application Data

[60] Division of Ser. No. 668,839, Mar. 22, 1976, and a continuation-in-part of Ser. No. 584,821, Jun. 6, 1975, abandoned, which is a continuation of Ser. No. 422,553, Dec. 6, 1973, abandoned.

[30] Foreign Application Priority Data

Dec. 28, 1972 [JP] Japan ..... 47-1802

[51] Int. Cl.[2] ..... G04C 3/00

[52] U.S. Cl. ..... 58/23 R; 58/85.5; 58/50 R

[58] Field of Search ..... 58/23 R, 85.5, 50 R

[56] References Cited

U.S. PATENT DOCUMENTS

| | | | |
|---|---|---|---|
| 3,834,152 | 9/1974 | Nishimura et al. | 58/85.5 X |
| 3,852,950 | 12/1974 | Yoda et al. | 58/85.5 X |
| 3,871,168 | 3/1975 | Maire et al. | 58/85.5 X |
| 3,928,959 | 12/1975 | Naito | 58/85.5 X |

*Primary Examiner*—Ulysses Weldon
*Attorney, Agent, or Firm*—Montague & Ross

[57] ABSTRACT

A set of digital indicators in an electronic display unit of a timepiece are actuated by driving pulses transmitted thereto through respective stages of a multistage frequency divider. A switching mchanism is manually operable to advance certain of these stages, independently of the driving pulses and at a faster rate, to adjust the display. A timer discriminates between short-term and long-term switch reversals to differentiate between a gating signal, giving passage to a train of high-rate stepping pulses, and (a) selection signals identifying an indicator to be stepped or (b) manually produced pulses for adjustment at a slower rate. A protective circuit may be inserted between the switching mechanism and the display-controlling circuitry for preventing the transmission of indication-modifying signals to the display unit in the absence of a special unblocking signal, generated separately, which trips an electronic relay such as a flip-flop into an off-normal condition for the emission of an enabling signal; the flip-flop may be automatically reset to normal, after a predetermined period, in the absence of a manually generated blocking signal. Stationary digital indicators, such as those registering the triggering time of an alarm circuit, may be similarly adjusted.

5 Claims, 6 Drawing Figures

ELECTRONIC TIMEPIECE

This is a division of application Ser. No. 668,839, filed Mar. 22, 1976 and a continuation-in-part of Ser. No. 584,821, filed June 6, 1975, now abandoned; which is a continuation of Ser. No. 422,533, filed Dec. 6, 1973, now abandoned.

FIELD OF THE INVENTION

Our present invention relates to an electronic timepiece with a chronometric display including several digital indicators.

BACKGROUND OF THE INVENTION

The various digital indicators of such timepieces are generally operated by driving pulses derived from respective stages of a frequency divider in the output of a crystal-stablized oscillator. They are usually provided with manual switches for modifying the reading of their indicators, as by resetting them to a reference (e.g. zero) position or setting them to the correct time. For the latter purpose it is known to provide a source of high-rate stepping pulses, derived from the same oscillator as the driving pulses but recurring with a substantially greater repetition frequency or cadence, which can be selectively connected to the several indicators in a so-called fast-feeding circuit. The switching mechanism controlling the delivery of these high-rate stepping pulses to the chronometric display may comprise a stem, similar to that used for winding conventional watches, or a set of pushbuttons.

OBJECTS OF THE INVENTION

An object of our present invention is to provide a simplified switching mechanism for such a timepiece, particularly for a compact chronometric instrument such as a wristwatch, which combines in a single actuating element a number of functions heretofore carried out by different elements, such as selection of a digital indicator and adjustment of same.

Another object is to provide means in such a timepiece for selectively changing the reading of a digital display at a rapid rate by automatically generated stepping pulses or at a slow rate by manual pulsing.

A further object of our invention is to provide, in such a timepiece, protective circuitry for preventing an untimely adjustment in the reading of any digital indicator thereof by, for example, accidental depression of a pushbutton.

SUMMARY OF THE INVENTION

According to an important feature of our invention, we provide a discriminator for distinguishing between different modes of operation of an associated manual switch, more particularly for differentiating between switch reversals of relatively short and relatively long duration. Thus, a timer in the discriminator ascertains whether or not a control pulse from an associated switch exceeds a predetermined threshold interval, thereby permitting different functions to be carried out by one actuating element.

In one embodiment, one or more brief switch reversals represent several setting modes designed to select a particular digital indicator to be adjusted; the resulting short-term control pulse or pulses are registered in a pulse counter of the discriminator circuit whose count controls a selector for the routing of the high-rate stepping pulses to the divider stage driving the respective indicator. The selector, however, is jointly controlled by the timer and the manual switch to give passage to these stepping pulses only if that switch is held reversed for a time longer than its threshold interval, the period of each reversal in excess of the threshold interval being available for the adjustment of the selected indicator by the stepping pulses. In such a system, accordingly, a single switch will suffice for the adjustment of any of several digital indicators.

In another embodiment, the short-term control pulses serve for the manual adjustment of an indicator whereas a long-term pulse, again exceeding a predetermined threshold interval, gives passage to high-rate stepping pulses for automatic adjustment by the fast-feeding method. This system allows the adjustment of a lower-ranking indicator (e.g. in the 1-minute digital position) by manual pulsing of an upstream divider stage and the adjustment of a higher-ranking indicator (e.g. in the 1-hour digital position) by automatic stepping via the same upstream stage and a downstream stage in cascade therewith.

According to a further feature of our invention, a discriminator inserted between a manual switching mechanism and a control unit for the setting of the several digital indicators forms part of a protective circuit giving passage to indication-modifying signals, emanating from the switching mechanism, only in the presence of a separate unblocking signal also generated by a switch of that mechanism. The emission of the unblocking signal, together with or in advance of the signals for the indicator adjustment, may trip an electronic relay such as a flip-flop which thereupon makes the control unit receptive to the indication-modifying signals until that relay is restored to normal by a subsequent blocking signal from the switching mechanism. Advantageously, a timer started by the unblocking signal measures a predetermined period after which the relay is automatically restored to normal, even in the absence of a manually generated blocking signal.

BRIEF DESCRIPTION OF THE DRAWING

The above and other features of our invention will now be described in detail with reference to the accompanying drawing in which.

SPECIFIC DESCRIPTION

Figure 1:
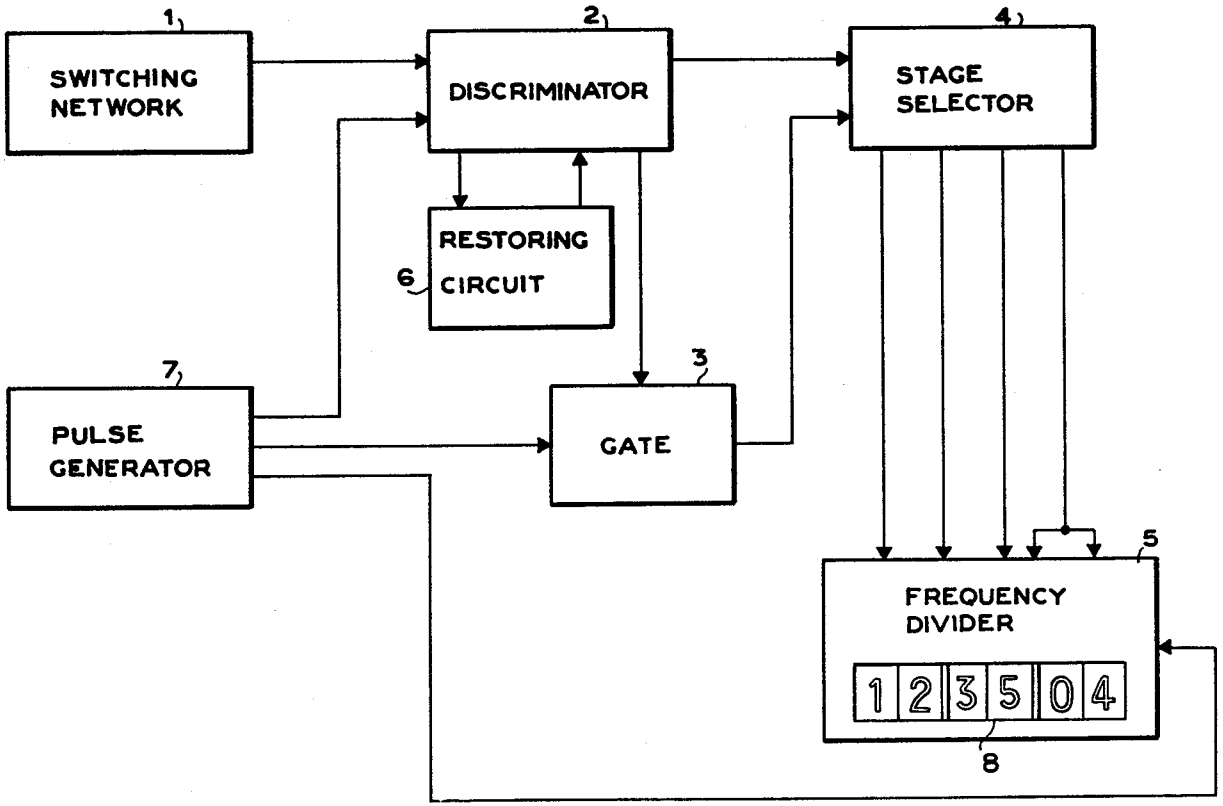
FIG. 1 is an overall block diagram of a system for adjusting an electronic timepiece in accordance with our invention.
Figure 2:
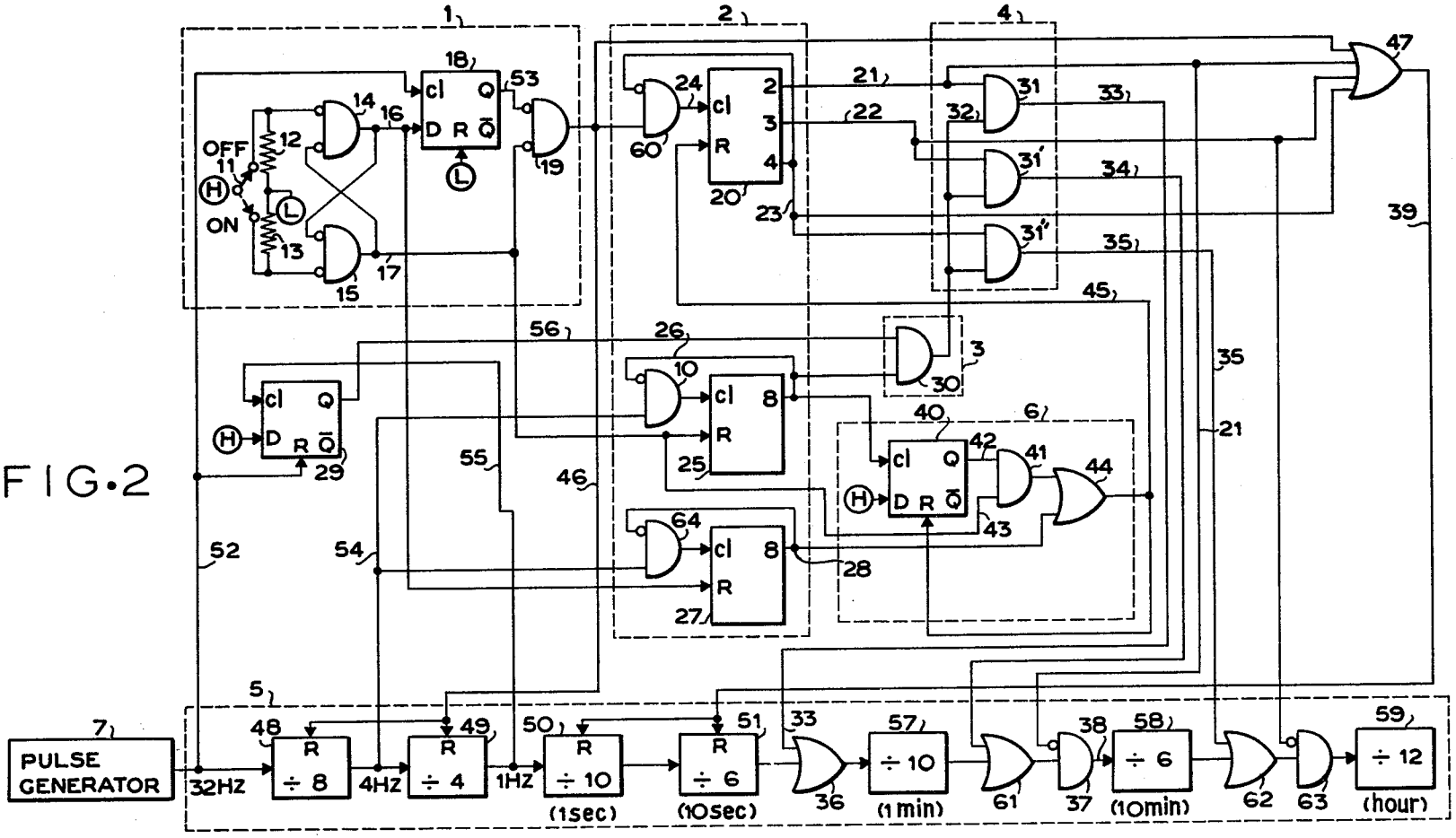
FIG. 2 is a more detailed circuit diagram of an embodiment of our invention.

In FIG. 1 we show a switching network 1 working into a discriminator 2 which distinguishes among different setting modes of a manual switch 11 (FIG. 2) in network 1 to control a gate 3 and a stage selector 4, the latter having a number of outputs terminating at respective stages of a frequency divider 5 which drives respective digital indicators of an electro-optical display unit 8. A pulse generator 7, operating at a frequency of 32 Hz as indicated in FIG. 2, is connected to frequency divider 5, discriminator 2 and stage selector 4, the gate 3 being inserted in the latter connection for normally blocking the passage of stepping pulses from generator 7 to a selected divider stage. Gate 3 has an enabling input 26 (FIG. 2) giving passage to the stepping pulses in response to a control mode of the switching circuit 1 as detected by discriminator 2. Upon a return of the switching circuit to a normal condition, discriminator 2 activates a restoring circuit 6 resetting a pulse counter 20 (FIG. 2) in the discriminator.

The following designations have been adopted in FIG. 2:

H: high voltage (energization)
L: low voltage (de-energization)
cl: clock-pulse or switching input
D: data input
Q: set output
$\overline{Q}$: reset output
S: setting input
R: resetting input Switching circuit 1 comprises the aforementioned manual switch 11 reversible between an OFF and an ON position. An associated bistable logic network, designed to eliminate the effects of contact chattering, comprises two cross-connected NOR gates 14 and 15 (shown as AND gates with inverting inputs) with a pair of input resistors 12 and 13 connected across the two bank contacts of switch 11. In the normal OFF position of the switch, a lead 17 is energized by NOR gate 15 to hold a pulse counter 25 in discriminator 2 in its reset condition. Lead 17 also extends to one of two inverting inputs of an AND gate 19, equivalent to a NOR gate, whose other input is tied via a lead 53 to the set output (Q) of a flip-flop 18. With switch 11 in its ON position, NOR gate 14 energizes via a lead 16 the data input (D) of flip-flop 18 as well as the resetting input (R) of another pulse counter 27 in discriminator 2. A lead 46 in the output of gate 19 simultaneously resets the two lowest-ranking stages 48 and 49 of frequency divider 5, with respective step-down ratios of 1:8 and 1:4, and also resets the two next-higher stages 50 and 51 of that divider, with step-down ratios of 1:10 and 1:6, via an OR gate 47 and its output lead 39. The conduction of lead 46, occurring upon the de-energization of lead 17 by the reversal of switch 11, terminates shortly thereafter as the flip-flop 18 is set with a predetermined minimum delay by the next clock pulse on its input cl, that clock pulse being obtained from an output lead 52 of generator 7 and having thus a cadence or repetition frequency of 32 Hz. Stages 50 and 51 are decadic pulse counters driving the one-second and 10-second indicators of display unit 8 shown in FIG. 1. Similar stages 57, 58 and 59, of respective step-down ratios 1:10, 1:6 and 1:12, drive the 1-minute, 10-minute and 1-hour indicators of that display unit.

Output lead 52 of pulse generator 7 extends to the clock-pulse input of flip-flop 18 and also to the input of the first divider stage 48 as well as to the resetting input of another flip-flop 29 receiving the 1-Hz output of stage 49 via a lead 55 on its clock-pulse input. Because of its quick resetting via lead 52, flip-flop 29 emits on an output lead 56 a narrow pulse recurring at a cadence of 1 Hz.

Discriminator 2 includes the aforementioned pulse counter 20 which, in its normal or zero position, is steppable by pulses delivered to its clock-pulse input (cl) via an output lead 24 of an AND gate 60 having an inverting input connecting by way of a lead 23 to the No. 4 output of this counter. Upon each reversal of switch 11 to its ON position, NOR gate 19 briefly energizes the noninverting input of AND gate 60 to advance the mode-distinguishing counter 20 by one step. Thus, counter 20 reaches its No. 2 position in response to two successive reversals of switch 11 from OFF to ON, energizing a lead 21; in response to three such reversals, the counter energizes a lead 22 connected to its No. 3 output, whereas upon four reversals the lead 23 is energized, thereby blocking the AND gate 60 and preventing further changes in the counter position.

Leads 21, 22 and 23 terminate at respective AND gates 31, 31′ and 31″ in selector 4 and also have extensions leading to OR gate 47 so as to reset the divider stages 50 and 51 via lead 39 whenever the counter 20 reaches any of its aforementioned off-normal positions. AND gates 31, 31′, 31″ are normally blocked by the de-energization of an output lead 32 of an AND gate 30 in gating circuit 3. Gate 30 has a first input connected to lead 56 and a second input connected to a lead 26 emanating from the No. 8 output of pulse counter 25, this lead 26 also extending to an inverting terminal of an AND gate 10 in the input of that counter; the noninverting input of gate 10 is tied to an output lead 54 of divider stage 48 emitting four pulses per second. Upon the de-energization of lead 17 by a movement of switch 11 into its ON position, the pulses traversing the gate 10 step the counter 25 until, after a threshold interval of 2 seconds, it reaches its No. 8 position and energizes the lead 26, thereby causing gate 30 to conduct in the set state of flip-flop 29 to unblock the AND gates 31, 31′, 31. These latter gates have output leads 33, 34, 35 terminating at respective OR gates 36, 61 and 62 in the outputs of divider stages 51, 57 and 58. Normally, these OR gates pass carry pulses from the preceding or upstream stages to the succeeding or downstream stages to step the higher-ranking digital indicators of display unit 8. OR gates 61 and 62, however, are in series with respective AND gates 37 and 63 having inverting inputs respectively connected to leads 21 and 22. Thus, the settings of 10-minute and 1-hour stages 58 and 59 are not changed while stepping pulses from lead 56 are fed via leads 32 and 33 to 1-minute stage 57; similarly, the stepping of 10-minute stage 58 is unaccompanied by any change in the position of 1-hour stage 59.

Restoring circuit 6 comprises a flip-flop 40 with a clock-pulse input connected to lead 26 and a set output (Q) having a lead 42 connected to one input of an AND gate 41 whose other input lead 43 is branched off lead 17 and is therefore energized only when the switch 11 is in its OFF position. AND gate 41 works into an OR gate 44 also connected to a lead 28 emanating from the No. 8 output of pulse counter 27. This counter, which is similar to counter 25, has its clock-pulse input (cl) fed via an AND gate 64 having an inverting input connecting to lead 28 and a noninverting input tied to lead 54 so that, with switch 11 in its OFF position to de-energize the lead 16, counter 27 is stepped at a rate of 4 Hz until it reaches its No. 8 position after the threshold interval of 2 seconds. In that position, no further stepping can take place since gate 64 is blocked; OR gate 44 conducts and energizes a lead 45 terminating at resetting inputs of counter 20 and flip-flop 40.

After a changeover from a setting mode (short-term reversal) of switch 11 to a control mode (maintenance in its ON position for more than two seconds), counter 25 and flip-flop 40 energize the input 42 of gate 41 so that this gate conducts immediately upon a subsequent return of the switch to its OFF position, thereby resetting the counter 20. If, however, switch 11 is not held for a prolonged period in its ON position, it must remain in its OFF position for more than 2 seconds in order to generate the resetting signal on lead 45.

Leads 26 and 28 may be considered respective output leads of a timer, consisting of pulse counters 25 and 27, which measures two separate threshold intervals of 2 seconds each. Naturally, these intervals need not be identical.

Let us assume, for example, that a user wishes to adjust the indicator for the 1-minute digit driven by stage 57 of frequency divider 5. Upon the first reversal of switch 11 to energize the lead 16 and de-energize the lead 17, a narrow pulse generated in the aforedescribed manner on lead 46 resets the fractional divider stages 48 and 49 as well as the 1-second and 10-second stages 50 and 51. Counter 20 takes one step, which is insufficient to energize any of its output leads 21 – 23. Counter 25 is also stepped, at the 4-Hz rate, from the output of divider stage 48 which simultaneously goes to the stepping input (cl) of counter 27; the latter counter, however, is arrested by the high voltage on lead 16 transmitted to its resetting input (R). If the user restores the switch 11 to its OFF position (as by releasing a spring-loaded push-button forming part of that switch) before the end of the two-second threshold interval measured by counter 25, that counter is reset to zero by the re-energization of lead 17. Another reversal of switch 11, this time for a period longer than two seconds, advances the mode-distinguishing counter 20 into its No. 2 position whereby lead 21 is energized. As the timing counter 25 reaches its full capacity after eight stepping pulses on lead 54, voltage on its output lead 26 blocks the passage of further stepping pulses through gate 10 and energizes one of the inputs of gate 30 in circuit 3. Upon the occurrence of the next 1-Hz pulse on lead 55, flip-flop 29 emits a narrow stepping pulse or spike on lead 56 to energize briefly the second input of AND gate 30 which thereupon conducts and, via its output lead 32, unblocks the AND gate 31 in selector 4. The spike from flip-flop 29 then passes via AND gates 30 and 31 as well as OR gate 36 to the one-minute stage 57 which thus takes one step per second until the corresponding digital indicator displays the desired numerical value. Divider stages 50 and 51 remain arrested in zero position during this time, owing to the presence of voltage on output lead 39 of OR gate 47. Furthermore, voltage on lead 21 blocks the AND gate 37 so that the higher-ranking stages 58 and 59 are not stepped.

Upon the subsequent restoration of switch 11, voltage on lead 17 reaches one input lead 43 of AND gate 41 whose other input lead 42 is held energized by flip-flop 40 as soon as counter 25 reaches its No. 8 position. Thus, gate 41 conducts and via OR gate 44 energizes the lead 45 to reset the counter 20 as well as the flip-flop 40.

In order to adjust the 10-minute digital indicator, switch 11 must be reversed twice for short periods and then remain for a longer period in its ON position. With counter 20 now in its No. 3 position to energize the lead 22, the high-rate stepping pulses represented by the spikes from flip-flop 29 pass through AND gate 30 (after the counter 25 has reached its No. 8 position) to AND gate 31' whence, via lead 34 and OR gate 61, they traverse the AND gate 37 and advance the divider stage 58 by way of its input lead 38. Voltage on lead 22 blocks the AND gate 63 so that the position of the hour indicator is again frozen. As before, divider stages 50 and 51 are zeroized by the energization of lead 39 so that the reading of the 1-minute indicator likewise remains unchanged.

With three short-term and one long-term reversal of switch 11, mode-distinguishing counter 20 takes four steps to energize its output lead 23 so that the spikes on lead 56 can pass through the AND gate 31" after the switch has been held in its ON position for more than 2 seconds. These spikes travel via lead 35 and OR gate 62 as well as AND gate 63 to the last divider stage 59 which is thereby stepped at the same high rate of 1 Hz as the preceding two stages in the instances described above.

If the user prematurely restores the switch 11, leaving it in its OFF position for more than 2 seconds, timing counter 27 energizes its output lead 28 and with it, via OR gate 44, the lead 45 to reset the counter 20 independently of flip-flop 40. The resetting of counter 27 occurs upon the next reversal of switch 11.

Figure 3:
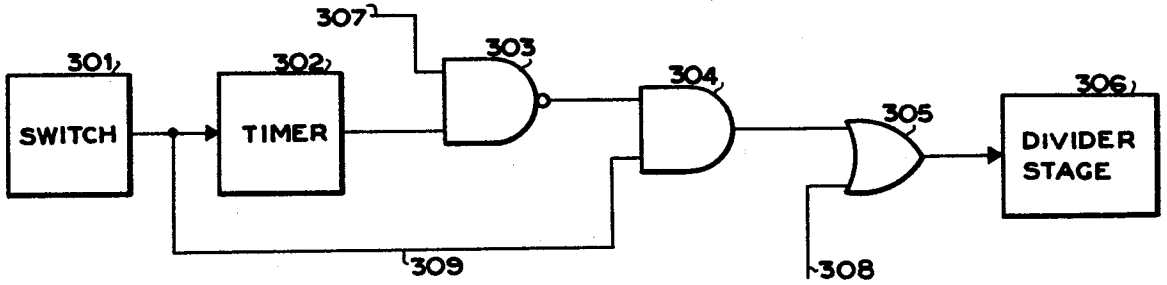
FIG. 3 is a block diagram of another embodiment.

We shall now refer to FIG. 3 showing another embodiment of our invention wherein a manually operable mechanical switch 301, equivalent to the switch 11 of FIG. 2, has an output lead 309 which is energized in the ON position of that switch. Lead 309 extends to a timer 302, similar to pulse counter 25 of FIG. 2, and in parallel therewith to one input of an AND gate 304. Timer 302 works into a NAND gate 303 also receiving, on an input lead 307, a train of high-rate stepping pulses such as the spikes emitted by flip-flop 29 in FIG. 2. The output of NAND gate 303 is tied to the other input of AND gate 304 whose own output extends through an OR gate 305 to a stepping input of a divider stage 306 forming part of a cascade of such stages as illustrated for the frequency divider 5 of FIG. 2. Driving pulses from the preceding stage of the cascade, not shown in FIG. 3, are delivered to stage 306 over a lead 308 through the same OR gate 305.

Timer 302 measures a predetermined threshold interval, e.g. of 1 second, at the end of which it energizes the corresponding input of NAND gate 303 to make the latter transparent to the stepping pulses on lead 307. These stepping pulses are then transmitted, in inverted form, to AND gate 304 which is conductive as long as switch 301 is reversed, i.e. in its ON position. Upon the restoration of that switch, timer 302 is reset (e.g. as described hereinafter with reference to FIG. 4) and NAND gate 303 again has a continuous output.

If the switch 301 is actuated for periods less than the threshold interval measured by timer 302, each reversal generates in the output of AND gate 304 a pulse which passes the OR gate 305 to step the divider stage 306 at a relatively slow rate, compared with that of the pulses on lead 307. Thus, the user may make larger adjustments by the fast-feeding method and may employ manual stepping for minor corrections. In particular, as more fully described below with reference to FIG. 4, the pulses on lead 307 may follow one another so rapidly that a digital indicator of higher rank, associated with a stage downstream of divider stage 306, may be adjusted in a short period; the lower-ranking indicator driven directly by stage 306 may then be set at a slower rate by manual pulsing. In such a case a single switch 301 may be used for adjustment of both the minute section and the hour section of the digital display 8 shown in FIG. 1.

Figure 4:
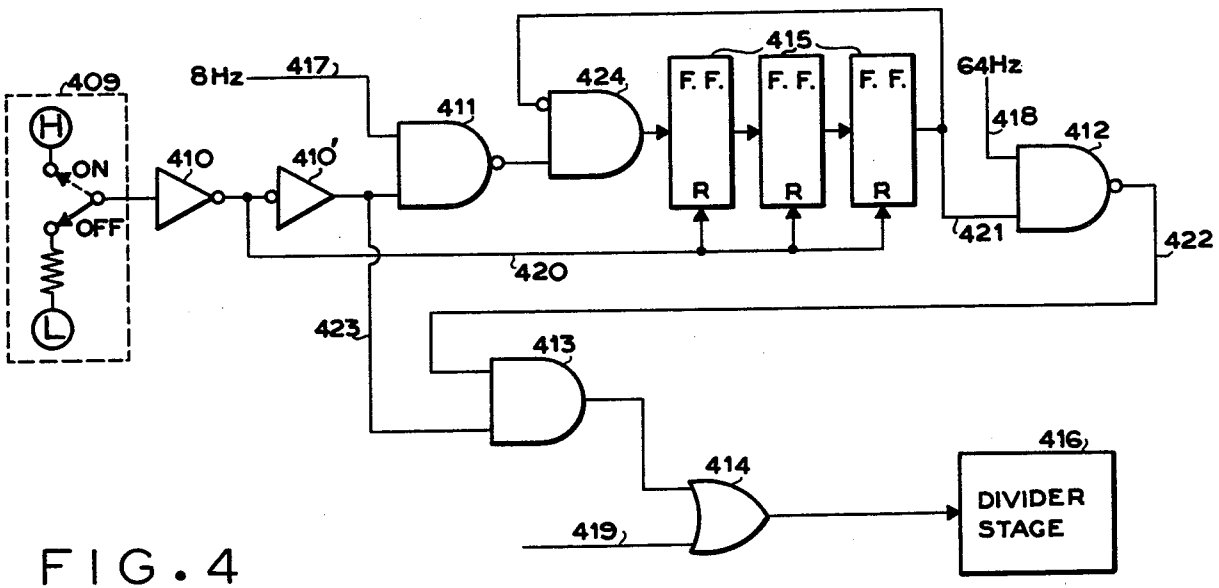
FIG. 4 is a more detailed circuit diagram of an embodiment similar to that shown in FIG. 3.

FIG. 4 shows details of a circuit generally similar to that of FIG. 3, including a manual switch 409 corresponding to switch 301, three cascaded flip-flops 415 together corresponding to timer 302, a NAND gate 412 corresponding to gate 303, an AND gate 413 corresponding to gate 304, an OR gate 414 corresponding to gate 305, and a divider stage 416 corresponding to stage 306. Two cascaded inverters 410, 410' are inserted between switch 409 and a NAND gate 411, the junction of these inverters being tied to a resetting lead 420 for timer 415. The first inverter 410 could be omitted if, contrary to the arrangement illustrated, the output of switch 409 were high (H) in its OFF position and low (L) in its ON position. NAND gate 411 receives timing pulses with a cadence of 8 Hz over a lead 417, these pulses being ineffectual in the OFF position of switch 409 in which the other input of that NAND gate is de-energized. Upon reversal of switch 409, these pulses pass through an AND gate 424 to a stepping input of the first flip-flop of timer 415 which therefore energizes its output lead 421 after eight such pulses corresponding to a threshold interval of $1 \pm \frac{1}{8}$ second. With lead 421 connected to an inverting input of AND gate 424, further timing pulses are blocked as long as the flip-flops 415 are not reset by a restoration of switch 409.

As long as lead 421 carries no voltage, NAND gate 412 energizes its output lead 422 to unblock the AND gate 413 whereby manually generated short-term pulses in the output of inverter 410', appearing on a lead 423, pass through gates 413 and 414 to advance the divider stage 416 at a slow stepping rate. Driving pulses from the preceding divider stage, appearing on a lead 419, are delivered to stage 416 through OR gate 414.

With lead 421 energized by a long-term reversal of switch 409, inverted stepping pulses with a cadence of 64 Hz on a lead 418 pass through gates 412, 413 and 414 to divider stage 416 which is thereby advanced at a rapid rate. Thus, if stage 416 controls the 1-minute digital indicator of display 8 (FIG. 1), the hour indicator will take approximately one step per second. The 1-minute and 10-minute stages could then be adjusted with coarse presetting by the fast-feeding method and finally set to the exact time by manual pulsing.

Figure 5:
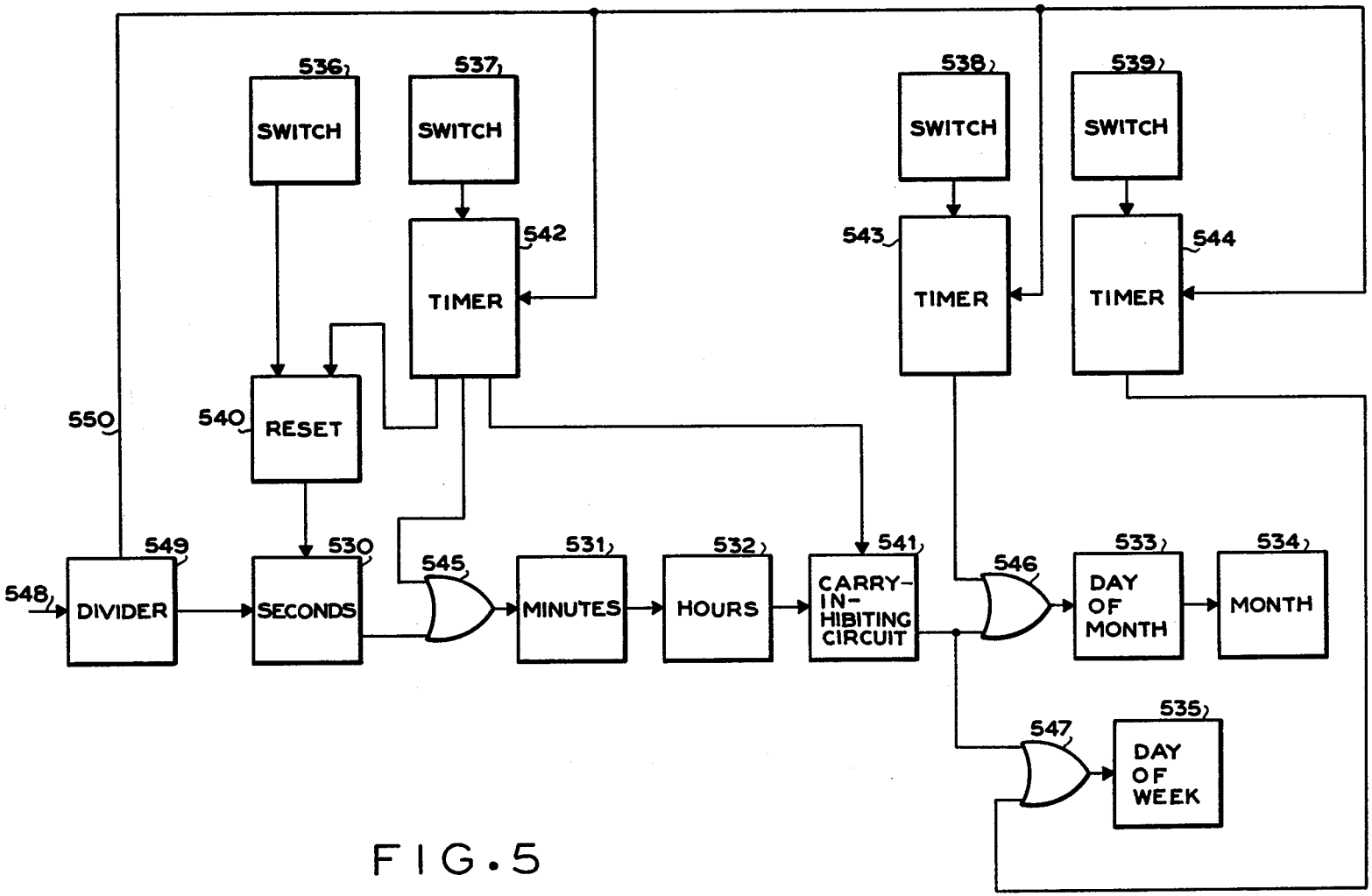
FIG. 5 is a block diagram for the circuitry of a timepiece incorporating the features of FIGS. 3 and 4.

In FIG. 5 we have shown a cascade of divider stages generally similar to those of FIG. 2, including a seconds counter 530, a minute counter 531, an hour counter 532, a day-of-month counter 533, a month counter 534 and a day-of-week counter 535, each of these divider stages driving a respective digital indicator or pair of such indicators not shown. Manual switches 536, 537, 538 and 539, similar to those described above, are provided for the purpose of adjusting the digital display by the aforedescribed technique of slow manual pulsing for lower-ranking stages and fast automatic stepping for higher-ranking stages. Switch 536 is used only for zeroizing the seconds indicator by way of a resetting circuit 540 connected to stage 530. Switch 537 serves to adjust the minute counter 531 and the hour counter 532 through a timing circuit 542 similar to that shown in FIG. 4, that circuit having an output terminating at an OR gate 545 (corresponding to gate 414 of FIG. 4) interposed between stages 530 and 531. Other output leads of circuit 542 extend to resetting circuit 540 and to a carry-inhibiting circuit 541, similar to gates 37 and 63 of FIG. 2, which is inserted in the output of hour counter 532 upstream of stages 533 and 535. An analogous timing circuit 543, controlled by switch 538, works into counter 533 through an OR gate 546 inserted between that counter and inhibiting circuit 541. Switch 539, finally, controls the counter 535 through another such timing circuit 544 working into an OR gate 547 interposed between components 541 and 535.

Stepping pulses are delivered to timing circuits 542, 543 and 544 from a fractional divider stage 549 upstream of stage 530, driven by clock pulses on a lead 548, via a lead 550 which corresponds to the lead 418 of FIG. 4.

As will be readily understood, hour counter 532 emits once every 24 hours a driving pulse reaching the two day counters 533 and 535 by way of OR gates 546 and 547, respectively. If the stepping pulses on lead 550 have the aforementioned cadence of 64 Hz, operation of switch 537 will again advance the hour indicator at a rate of about one step per second; the day-of-month indicator controlled by stage 533 may be stepped manually by short-term reversals of switch 538, a long-term actuation of that switch then resulting in a change of the month reading by means of stage 534 at a rate of about two steps per second. For setting the day of the week by the fast-feeding method, the 64-Hz pulse cadence may be stepped down in timing circuit 544 to a lower repetition frequency of, say, 1 Hz. Alternatively, switch 539 may be designed only for manual stepping in which case the circuit 544 may be omitted.

The resetting circuit 540 may comprise a flip-flop such as the one shown at 18 in FIG. 2.

Figure 6:
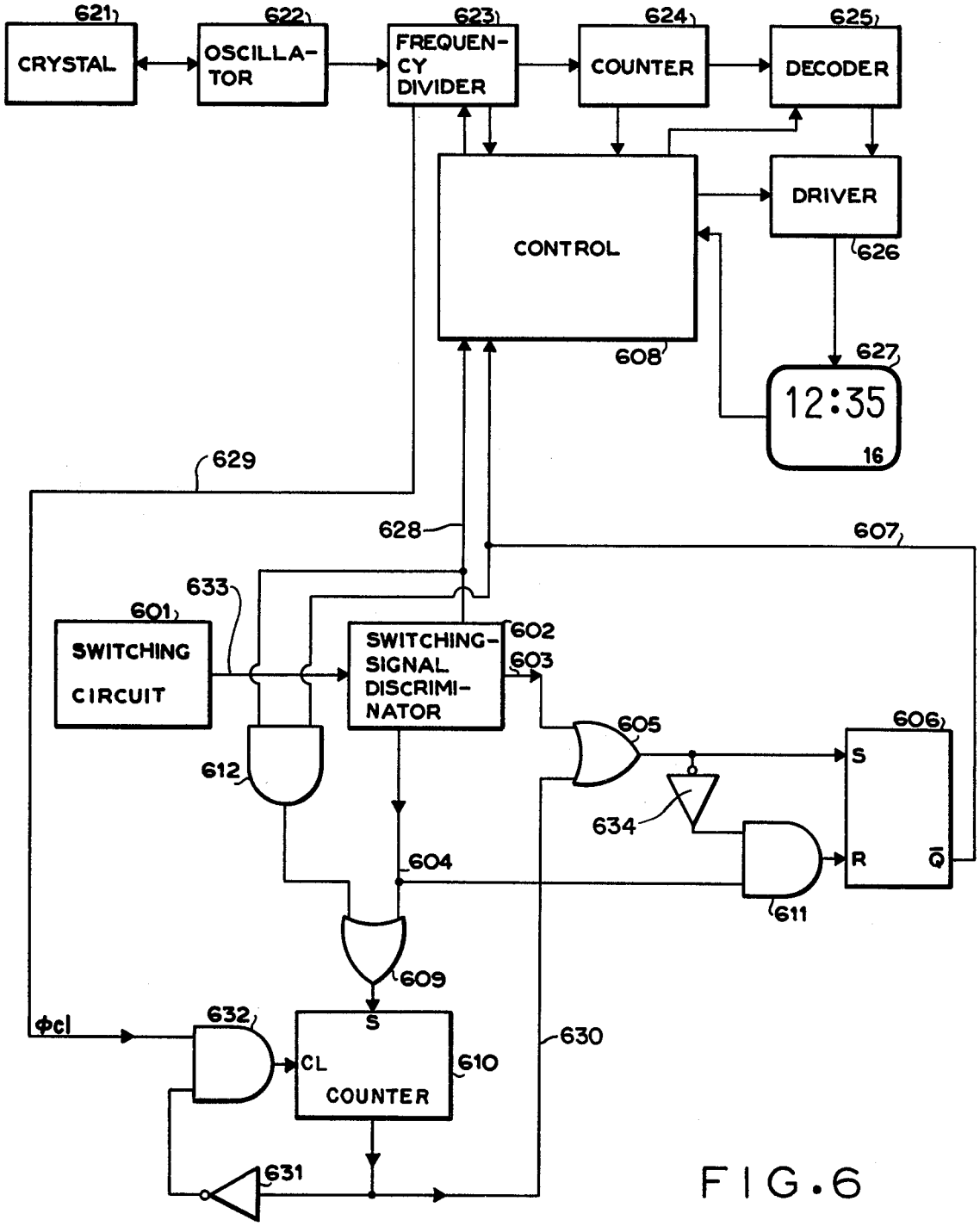
FIG. 6 is a circuit diagram of a further embodiment.

In FIG. 6 we have represented the overall circuitry of an electronic timepiece embodying our invention, including a digital display 627 similar to unit 8 of FIG. 1. The clock pulses for driving the display are generated by an oscillator 622 controlled by crystal vibrator 621. A frequency divider 623 steps down the operating frequency of oscillator 622 to a value of, say, 64 or 32 Hz in the input of a multistage frequency divider 624 consisting of a number of cascaded pulse counters as shown in FIGS. 2 and 5. The stages of divider 624 act upon the display 627 through a decoder 625 and a driving circuit 626.

A control unit 608, communicating with the several components 623 – 627, may include timers and pulse counters — as described in connection with preceding Figures — designed to modify the reading of display unit 627 in response to manually or automatically generated stepping pulses, unit 608 responding to indication-modifying signals or data emitted on a lead 628 by a discriminating circuit 602 with input connections 633 to a switching mechanism 601. The indication-modifying signals may comprise short-term and long-term pulses, as hereinabove described, or certain voltages or voltage combinations produced by one or more switches in unit 601; thus, connections 633 may comprise a plurality of leads not separately illustrated.

In accordance with this aspect of our invention, control unit 608 remains nonresponsive to the indication-modifying signals or data on lead 628 in the absence of an enabling signal on another lead 607, the latter originating at a reset output ($\overline{Q}$) of a flip-flop 606 which is settable and resettable by discriminator 602. Flip-flop 606 constitutes an electronic relay which, together with discriminator 602, forms part of a protective circuit to prevent untimely operation of control unit 608. The setting input (S) of this flip-flop is connected through an OR gate 605 to an output lead 603 of discriminator 602 and also to an output lead 630 of a pulse counter 610 connected to receive clock pulses $\phi_{cl}$ from frequency divider 623 via a lead 629 and an AND gate 632. Normally, counter 610 is in a starting position in which it energizes the lead 630, that lead being also connected through an inverter 631 to another input of AND gate 632 which therefore blocks the transmission of clock pulses to a corresponding input (cl) of the counter. Another input (S) of this counter is connected via an OR gate 609 to a second output lead 604 of discriminator 602 and also to an output of an AND gate 612 with input connections to leads 607 and 628.

A safety switch, not shown, in unit 601 can be manually operated in one of two ways to produce either an unblocking signal or a blocking signal of short duration. The short blocking signal causes the discriminator 602 to energize its output lead 603 whereby flip-flop 606 is set, thus de-energizing the lead 607 so that any indication-modifying signal appearing on lead 628 remains ineffectual; leads 607 and 628 may terminate, for example, at a common AND gate within unit 608. That safety switch may be physically separated from a display-setting switch, such as the one shown at 11 in FIG. 2, which produces the indication-modifying signals. In principle, however, a single actuating element may be provided for operating both switches, e.g. a pushbutton that can be depressed to reverse the switch 11 and can also be rotated in one or the other direction for emitting the blocking and the unblocking signal, respectively. Such unblocking signal, in any event, must accompany or precede the indication-modifying signals in order to cause the energization of output lead 604 of discriminator 602 for the purpose of resetting the flip-flop 606 and transmitting an enabling signal via lead 607 to control unit 608. The resetting circuit of flip-flop 606 includes an AND gate 611 having one input tied to lead 604 and another input connected by way of an inverter 634 to the output of OR gate 605. Such energization of lead 604 also starts the counter 610 which de-energizes its output lead 630 as a prerequisite for the resetting of flip-flop 606; this operation opens the AND gate 632 to the clock pulses $\phi_{cl}$ with resulting further stepping of counter 610 whose capacity is sufficient to measure a period allowing all the necessary display-adjusting operations to be carried out.

The user, having activated the protective circuit by the short unblocking signal, is expected to generate the blocking signal after completing the adjusting operations, thereby causing the discriminator 602 to re-energize its output lead 603. Such re-energization sets the flip-flop 606 and removes voltage from lead 607 but does not inhibit the further advance of counter 610 to the limit of its capacity. When that limit is reached, counter 610 re-energizes its lead 630 and reblocks the AND gate 632. The circuit is thus returned to normal.

If, however, the user neglects to operate the safety switch with emission of the blocking signal, flip-flop 606 remains set until the counter 610 has returned to its starting position with energization of lead 630. In this instance the protective circuit is also restored to normal, yet the user will then have to reposition the safety switch in unit 601 before being able to generate another unblocking signal for further adjustment of display 627.

The enabling period measured by counter 610 may be on the order of 1 minute, for example.

The applicability of our invention is not limited to wristwatches but extends also other types of timepieces, e.g. a chronograph.

While we have particularly described the use of our improved adjusting systems in connection with periodically driven indicators of an electronic display unit, it should be understood that these systems can also serve for the setting of stationary display indicators such as those registering the triggering time of an alarm circuit. In that case, of course, the indicators are not periodically advanced by driving pulses from the associated stages or counters of a frequency divider.

We claim:

1. In an electronic timepiece, in combination:

display means for giving a reading of time;

switch means for setting said display means, said switch means being manually operable in a short-duration first mode and a long-duration second mode;

timing means connected to said switch means for distinguishing between said modes;

a source of stepping pulses for changing the reading of said display means; and circuitry extending from said switch means to said display means for changing said reading at a relatively slow rate by pulses manually generated by operating said switch means in said first mode, said circuitry being controlled by said timing means for connecting said source to said display means in response to operation of said switch means in said long-duration mode for changing said reading at a relatively fast rate by said stepping pulses.

2. The combination defined in claim 1 wherein said circuitry comprises gate means inserted between said source and said display means for normally blocking the passage of said stepping pulses to said display means, said gate means having an input connected to said timing means.

3. The combination defined in claim 1 wherein said display means includes a plurality of digital indicators actuated by driving pulses from respective stages of a periodically pulsed multistage frequency divider, said circuitry being connected to an upstream stage of said divider for adjusting a lower-ranking indicator by said manually generated pulses and for adjusting a higher-ranking indicator, controlled by a downstream stage of said divider in cascade with said upstream stage, by said stepping pulses at a rate substantially higher than the cadence of the driving pulses reaching said upstream stage.

4. The combination defined in claim 3 wherein said higher-ranking indicator is an hour counter, said stepping pulses having a cadence of 64 Hz.

5. The combination defined in claim 3 wherein said downstream stage is a month counter and said upstream stage is a day-of-month counter.

* * * * *